US009278790B2

(12) United States Patent
McPherson et al.

(10) Patent No.: US 9,278,790 B2
(45) Date of Patent: Mar. 8, 2016

(54) LYOPHILIZATION TRAY LID

(71) Applicants: Derrell Craig McPherson, Fredericksburg, VA (US); Christopher L. Hooban, Sterling, VA (US); Robert Michael Kinter, Waldorf, MD (US); Dena H. Kota, Spotsylvania, VA (US); Zachary A. Minter, Fredericksburg, VA (US)

(72) Inventors: Derrell Craig McPherson, Fredericksburg, VA (US); Christopher L. Hooban, Sterling, VA (US); Robert Michael Kinter, Waldorf, MD (US); Dena H. Kota, Spotsylvania, VA (US); Zachary A. Minter, Fredericksburg, VA (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 154 days.

(21) Appl. No.: 14/300,346

(22) Filed: Jun. 10, 2014

(65) Prior Publication Data

US 2015/0353248 A1 Dec. 10, 2015

(51) Int. Cl.
*F26B 5/06* (2006.01)
*B65D 51/24* (2006.01)

(52) U.S. Cl.
CPC ..... *B65D 51/241* (2013.01); *F26B 5/06* (2013.01)

(58) Field of Classification Search
CPC ..... F26B 5/00; F26B 5/06; F26B 9/00; F26B 11/00; B65B 1/00; B65B 1/04; B01D 5/00; B01D 5/072; C02F 9/00; C02F 9/005
USPC ..... 34/284, 287, 92; 62/125; 604/415; 141/11, 59, 69
See application file for complete search history.

(56) References Cited

U.S. PATENT DOCUMENTS

| | | | | | |
|---|---|---|---|---|---|
| 3,454,178 | A * | 7/1969 | Bender | B65D 51/002 | 215/277 |
| 4,084,330 | A * | 4/1978 | Fraser | F26B 5/06 | 220/235 |
| 4,105,407 | A * | 8/1978 | Sanderson | A61L 2/26 | 220/316 |
| 4,445,550 | A * | 5/1984 | Davis | B65D 37/00 | 141/329 |
| 4,609,102 | A | 9/1986 | Blum | 206/216 | |
| 4,872,572 | A | 10/1989 | Schrooten | 215/307 | |
| 5,065,908 | A * | 11/1991 | Mengeu | B65D 47/185 | 215/355 |
| 5,090,132 | A * | 2/1992 | Kobayashi | F26B 5/06 | 34/302 |
| 5,303,835 | A | 4/1994 | Haber et al. | 215/247 | |
| 5,522,155 | A * | 6/1996 | Jones | B65D 51/1616 | 34/286 |
| 5,689,895 | A * | 11/1997 | Sutherland | F26B 5/06 | 215/310 |
| 5,732,837 | A | 3/1998 | Jones | 215/311 | |

(Continued)

*Primary Examiner* — Stephen M Gravini
(74) *Attorney, Agent, or Firm* — Gerhard W. Thielman, Esq.

(57) ABSTRACT

A lid assembly is provided for covering and sealing a lyophilizer tray that contains a material for freeze-drying into a product in a lyophilizer chamber. The tray has an opening defined by a peripheral lip. The lid assembly includes a first lid disposable to seal around the lip of the tray, second lid disposed on the first lid, and a filter paper disposed therebetween. The first lid includes an opening. The second lid covers the opening and includes a hole over the opening. The filter paper is disposed over the opening between the first and second lids for inhibiting the product from escaping the tray through the hole while permitting water vapor to pass therethrough. With a lyophilization stopper to seal the hole, the tray containing the product can be protected from environmental humidity even after removal from the chamber.

14 Claims, 3 Drawing Sheets

(56) References Cited

U.S. PATENT DOCUMENTS

| | | | | |
|---|---|---|---|---|
| 5,819,964 | A | 10/1998 | Grimard | 215/419 |
| D430,939 | S | 9/2000 | Zukor et al. | D24/216 |
| 6,199,297 | B1 * | 3/2001 | Wisniewski | B65D 51/241 206/439 |
| 6,566,144 | B1 | 5/2003 | Madril et al. | 437/177 |
| 6,610,252 | B2 | 8/2003 | Madril et al. | 422/99 |
| 7,520,670 | B2 * | 4/2009 | Schwegman | F26B 5/06 215/200 |
| 7,966,746 | B2 * | 6/2011 | Py | F26B 5/06 34/285 |
| 9,121,637 | B2 * | 9/2015 | Ling | F26B 5/06 |
| 2010/0049156 | A1 | 2/2010 | Dickhorner et al. | 604/403 |
| 2012/0152957 | A1 * | 6/2012 | Smith | A61L 2/26 220/495.01 |
| 2015/0353248 | A1 * | 12/2015 | McPherson | F26B 5/06 220/212 |

* cited by examiner

LYOPHILIZATION TRAY LID

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to lyophilization accessories. In particular, the invention relates to a high efficiency particulate air (HEPA) filtered, sealable lid for a bulk lyophilization tray.

Freeze drying involves four stages: pre-treating, freezing, primary drying and secondary drying. Pretreatment of a sample material can include increasing concentration, increasing surface area, and reducing vapor pressure. The freezing process involves cooling the material below its thermodynamic triple point (i.e., the lowest temperature in which solid and liquid phases coexist). In the primary drying phase, the pressure is reduced to a few millibars by a partial vacuum and the material is heated to sublime the water therein, thereby removing the ice. The secondary drying phase removes the unfrozen water from the material, often with reduced pressures. Afterwards, the vacuum can be disengaged with inert gas, such as nitrogen, before sealing the freeze dried material, referred to herein as a product.

Bulk freeze drying (lyophilization) uses a tray to contain and transfer frozen material, such as biological organisms, pharmaceuticals, or other materials, to and from a freeze dryer (lyophilizer) before, during and after the freeze drying process. These trays are open, stainless steel trays designed to fit specifically in a particular freeze dryer, but the dimensions can be modified to fit any bulk lyophilization tray for any make or model freeze dryer. As the material dries, some particulates therefrom may be prone to escape from the lyophilizer tray, resulting in reduced product yield.

Moreover, when vacuum is released from the inside of the lyophilizer, some of the product may tend to dissipate into the air due to turbulence of air rushing into the inside of the lyophilizer. This can result in contamination of the lyophilizer and loss of product. Following the freeze drying process and disengagement of the vacuum, the tray containing the product is removed from the freeze dryer and directly exposed to environmental humidity, which could be detrimental to the product. There is currently no conventional item that protects the material and equipment that does not interfere with the freeze drying process.

Several solutions have been posed to address these issues for bulk lyophilizers. For example, a single-use tray is marketed where the operator first fills the tray with some quantity of material to be dried through a hole in the top, which is sealed with a screw-on cap before placing the tray into the freeze dryer. Once the material is dry and the vacuum disengaged, the tray is removed from the freeze dryer. The operator then cuts the entire top off the tray to access the lyophilized material, which makes the trays single use only. These trays do not enable an operator to seal the trays inside of the lyophilizer and thus, potentially expose the material to environmental humidity. Also, Lyoguard® trays do not fit in benchtop models of lyophilizers and decrease visibility of product.

An alternate solution employs bags with a heat sealer to contain lyophilized material. The bags permit vapor to escape, but decelerate the lyophilization process. The bag wraps the entire tray and, thus, prevents intimate contact between the tray and the shelf, which is required to maintain efficient temperature control to the product. Conventionally, this involves a manual process, yielding inconsistent results. Furthermore, these bags are one-time-use only. Thus, there is a need for a reusable device that can be used with standard lyophilizers to protect the material and equipment before, during and after the freeze drying process, as well as provide improved safety protection of operators from contamination.

SUMMARY

Conventional tray lids yield disadvantages addressed by various exemplary embodiments of the present invention. In particular, various exemplary embodiments provide a lyophilization tray lid for containing material within a bulk lyophilization tray container during the freeze drying process and then seal the dried material (i.e., product) within the tray container to protect that material from humidity upon removal of the tray and product from the freeze dryer. The lyophilization tray lid covers the tray container and enables vapors to exit therefrom during lyophilization while containing the product.

In exemplary embodiments, the tray lid can utilize the built-in stoppering function of the lyophilizer to press stoppers into holes in the lid, thereby sealing the tray while remaining inside the freeze dryer chamber. When the tray container containing the product is removed from the chamber, the product is protected from environmental humidity.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

Figure 1:
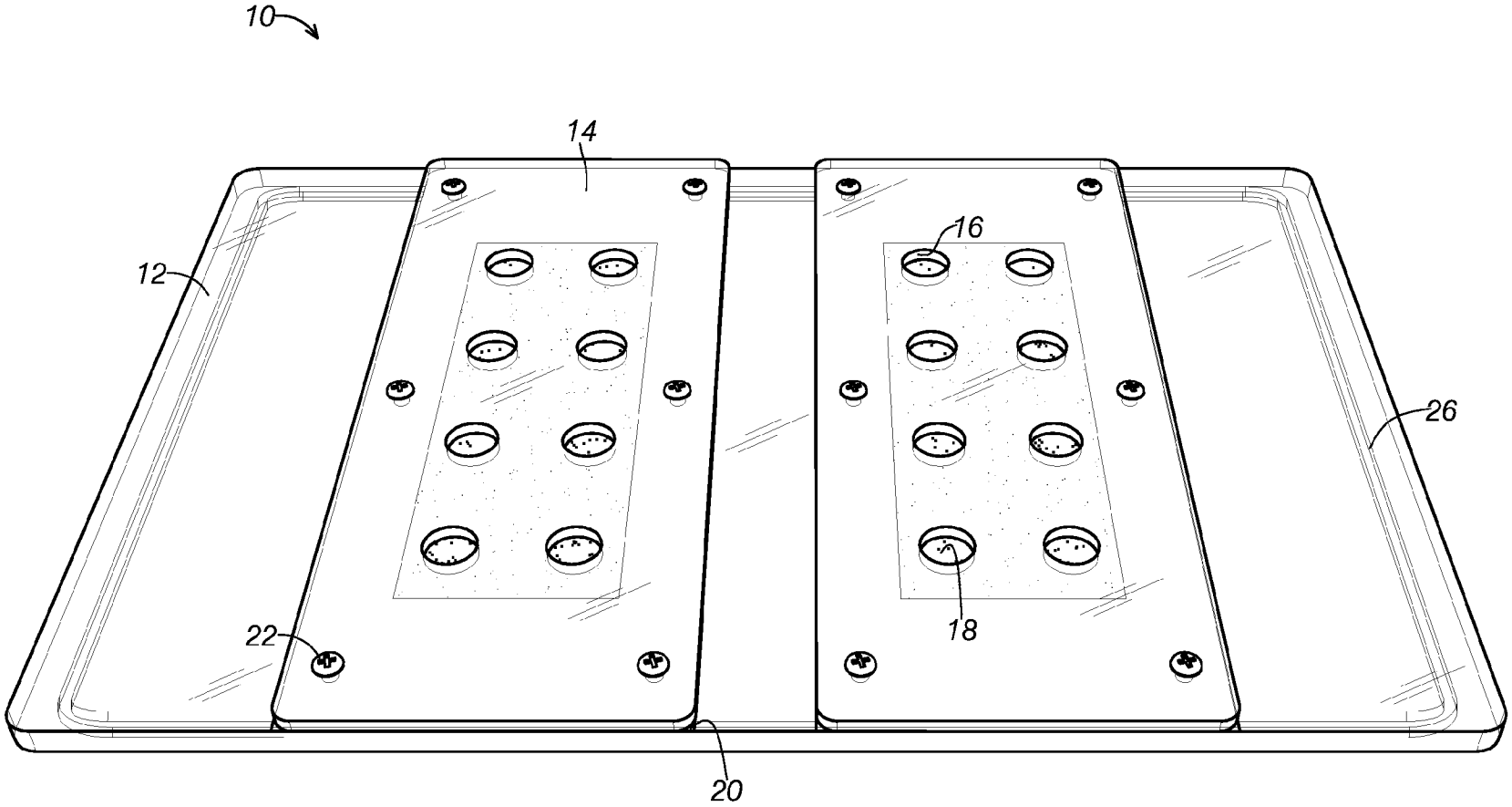
FIG. 1 is a perspective view of an exemplary lyophilizer tray lid assembly.

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

One aspect of the disclosed embodiments provides an exemplary lid assembly for covering a tray that includes a primary lid; at least one opening formed through the primary lid; at least one secondary lid disposed to cover the opening; holes formed in the secondary lid; and a filter paper disposed between the primary lid and the secondary lid. The filter paper inhibits escape of material from the tray through the holes. In another aspect of the present disclosure, the lid assembly further includes a gasket material disposed between the secondary lid and the primary lid to hold the filter paper in position; and fasteners disposed to removably secure the secondary lid to the primary lid.

Yet another aspect of the exemplary embodiments provides a method for containing a product in a lyophilization tray before, during and after lyophilization. This method includes disposing a product to be freeze dried into the lyophilizer tray; placing a lid assembly over the lyophilizer tray; disposing lyophilization stoppers atop the holes prior to inserting the tray and lid into the freeze dryer chamber; lyophilizing the product in a lyophilization chamber; releasing the vacuum inside the chamber upon lyophilization completion; and pressing the stoppers into the corresponding holes to seal the material inside the tray.

The lid assembly includes a primary lid, at least one opening formed through the primary lid, at least one secondary lid disposed to cover the opening, holes formed in the secondary lid, and filter paper disposed between the primary lid and the secondary lid. These and other features, aspects and advantages of various exemplary embodiments will become better understood with reference to the following drawings, description and claims.

The present disclosure relates generally to a lyophilization tray lid assembly that can contain material within a bulk lyophilization tray during the freeze drying process, and then seal the dried material within the tray container to protect that material from humidity once the tray and product are removed from the freeze dryer. The lyophilization tray lid assembly covers the tray container and enables vapors to exit the tray while containing the product.

The tray lid assembly can utilize the built-in stoppering function of the freeze dryer to press stoppers into holes in the lid assembly, thereby sealing the tray container while remaining inside the freeze dryer chamber. Upon removal of the tray container containing the product from the chamber, the product is protected from environmental humidity.

FIG. 1 shows a perspective view of a lyophilizer tray lid assembly 10, which includes a primary lid 12 with a peripheral groove 26 that forms a continuous channel on the lid's distal side. At least one secondary lid 14 (with two units depicted) is disposed on the proximal side of the primary lid 12. Both lids 12 and 14 constitute rectangular shaped thin-shell plates (i.e., thickness at least one order of magnitude less than the lateral sides). The secondary lid 14 includes holes 16 (with eight arrayed) penetrating therethrough to reveal filter paper 18 underneath.

Figure 2:
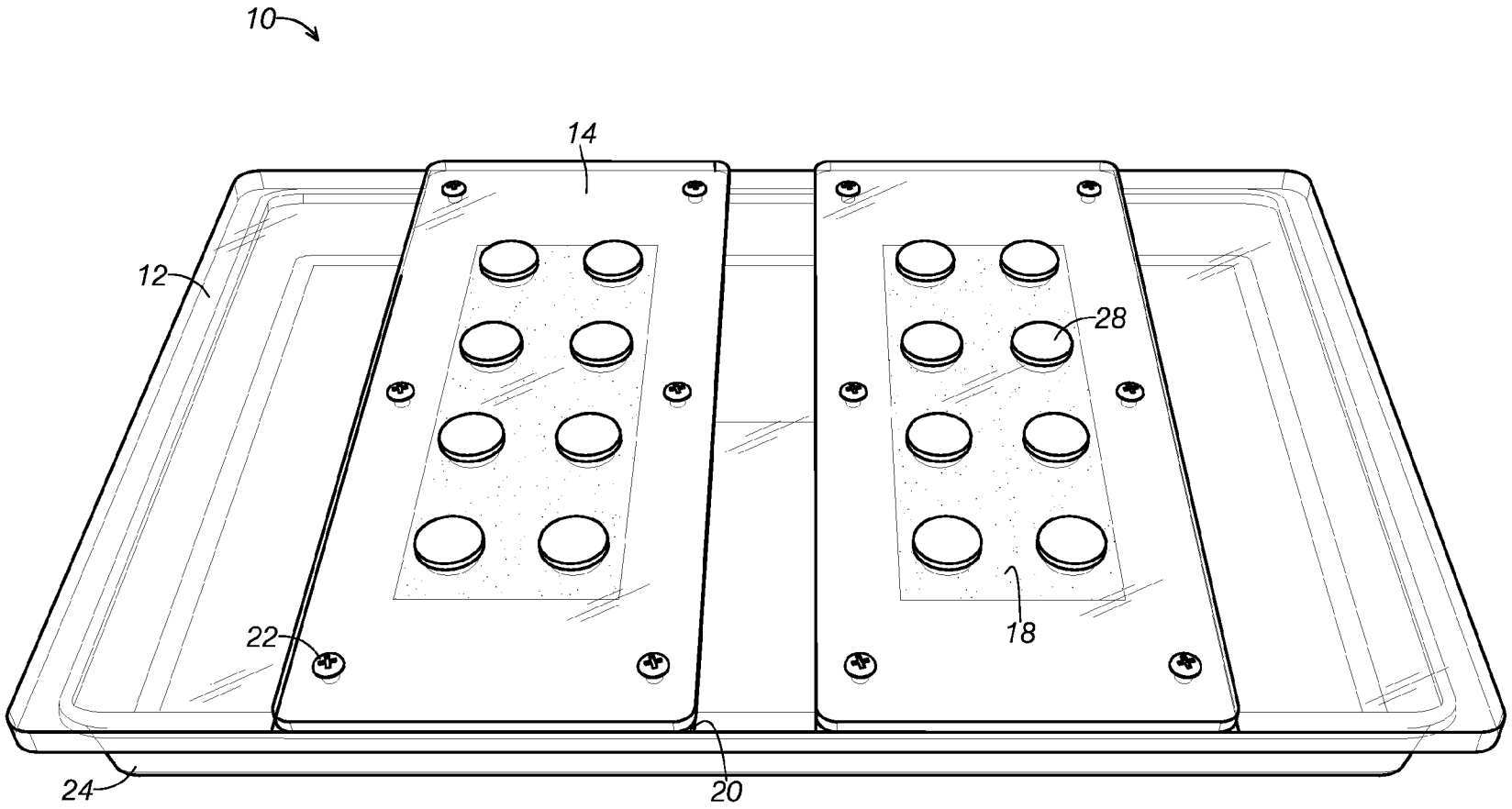
FIG. 2 is a perspective view of the exemplary lyophilizer tray lid disposed on a lyophilizer tray container.

A gasket 20 containing the filter paper 18 is disposed between the lids 12 and 14, which are secured together by screws 22 (or alternative fasteners) that penetrate through the secondary lid 14 and into the primary lid via cavities in mutual alignment. FIG. 2 shows a perspective view of the tray lid assembly 10 disposed on a lyophilizer tray container 24 that houses the sample material to be freeze-dried. A stopper 28 covers each hole 16 on the secondary lid 14.

Figure 3:
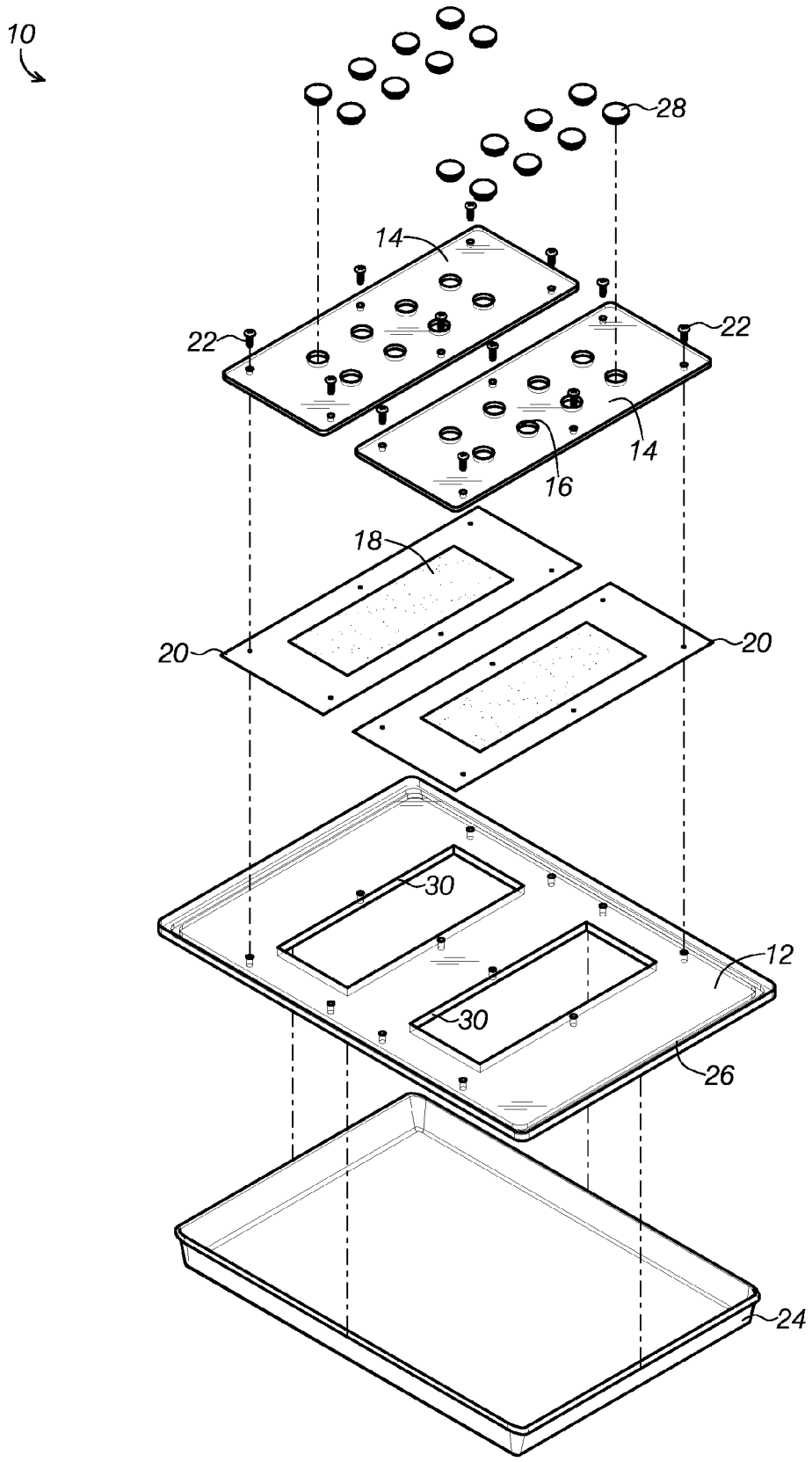
FIG. 3 is an exploded perspective view of the exemplary lyophilizer tray lid and tray container components.

FIG. 3 shows an exploded perspective view of the lyophilization container assembly. The tray container 24 includes a peripheral lip at its top opening. The groove 26 of the primary lid 12 receives the lip (shown by lower dash alignment lines) after a sample for freeze drying is disposed within the tray container 24. The primary lid 12 includes at least one opening 30 (corresponding to the array of holes 16 of each secondary lid 14). Although a single rectangular opening 30 is depicted for the corresponding secondary lid 14, other geometries and quantities can be considered without departing from the scope of the invention.

The gaskets 20 are disposed on the primary lid 12 aligned so as to enable the filter paper 18 on the gasket 20 to cover the corresponding opening 30 in the primary lid 12. The filter paper 18 enables water vapor to escape from the tray container 24 while restricting particulate material from passing therethrough. The secondary lids 14 are disposed over their corresponding gaskets 20 onto the primary lid 12. The holes 16 in the secondary lids 14 are arranged so as to be disposed within the perimeter of the opening 30, albeit separated therefrom by the filter paper 18. The screws 22 insert sequentially into corresponding cavities at the peripheries of the secondary lid 14, gasket 20 and the primary lid 12 (shown by mezzanine dash alignment lines). The stoppers 28 can be inserted into their corresponding holes 16 (shown by upper dash alignment lines).

Referring again to FIGS. 1, 2 and 3, the lyophilizer tray lid assembly 10 can include the primary lid 12 and the secondary lids 14 that contain the plurality of holes 16 formed therethrough. The primary lid 12 can include openings 30 cut therein over which the secondary lids 14 are correspondingly positioned. The openings 30 are formed through the primary lid 12 in an array larger than the footprint of the holes 16 in the secondary lids 14 and smaller than the length and width of the secondary lids 14. While the openings 30 are shown as rectangular shaped in FIG. 3, the openings 30 can be formed in various geometric and non-geometric shapes, provided that each opening 30 aligns with its corresponding hole 16 of the secondary lids 14.

Filter paper 18 can be disposed on a bottom or distal side (i.e., facing the tray) of the secondary lid 14 to cover the openings 30. Typically, one unit of filter paper 18 can completely cover each opening 30 of the primary lid 12. However, multiple pieces of filter paper 18 can be stacked upon each other, provided that the filter paper 18 covers the entirety of openings 30 without gaps that would enable product to escape from the tray container 24 sealed by the lyophilizer tray lid assembly 10. The filter paper 18 can be an HEPA filter paper sheet, and can be sized to cover the opening 30 of the primary lid 12.

The gasket 20 can be disposed between the secondary lid 14 and the primary lid 12. The gasket 20 can help ensure a seal between the secondary lid 14 and the primary lid 12 as well as hold the filter paper 18 in position. The gasket 20 can be shaped to fit on the primary lid 12, surrounding the opening 30 of the primary lid 12. Typically, the gasket 20 is sized to match the length and width of the secondary lid 14. The gasket 20 can be disposed above or below the filter paper 18. In some embodiments, two gaskets 20 can be used to sandwich the filter paper 18 therebetween.

A plurality of fasteners, such as the screws 22 can be used to secure the secondary lid 14 onto the primary lid 12. Of course, other fasteners may be employed to position and retain the secondary lid 14 on the primary lid 12. The screws 22 enable an operator to separate the secondary lid 14 from the primary lid 12 to, for example, replace the filter paper 18 with a clean piece of filter paper. The tray lid assembly 10 fits onto the lyophilizer tray container 24. The tray lid assembly 10 can be formed in various shapes and sizes, depending on the shape and size of the particular tray container 24.

The primary lid 12 can include a groove 26 cut about a bottom or distal side outer periphery thereof to help properly position the lid assembly 10 onto the lyophilizer tray container 24. Stoppers 28 can be designed to fit into the holes 16 of the secondary lids 14. The stoppers 28 preferably should be lyophilization style stoppers that enable passage of lyophilized vapors out of the tray container 24 while seated atop the holes 16, for example. The stoppers 28 can be disposed inside of the lyophilizer (not shown) and can be pressed into the holes 16 of the secondary lid 14 via an automatic stoppering function of the lyophilizer for sealed containment.

Therefore, an operator is not required to remove the lyophilizer tray container 24 (and, therefore, the product therewithin) from the lyophilizer without having the product sealed within a container. The primary lid 12 and the secondary lid 14 can be formed from a clear transparent material, enabling the operator to visualize the material therewithin, or alternatively an opaque material. In some embodiments, an auxiliary orifice can be disposed through the primary lid 12 to enable a temperature probe to be inserted into the lyophilizer tray container 24 and then sealed with a pliable material, such as putty.

While the drawings show two secondary lids 14 fitting over two corresponding openings 30 in the primary lid 12, a single secondary lid 14 or else more than two secondary lids 14 can be used within the scope of the present invention. Typically, the number of secondary lids 14 can be determined based on the size and shape of the lyophilizer tray container 24, where larger tray containers would typically include more openings 30 in the primary lid 12 and, thus, more secondary lids 14. Similarly, the number of holes 16 in each secondary lid 14 and the corresponding number of stoppers 28 can vary from the eight each depicted in the drawings, without departing from the inventive scope of the embodiments.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. A lid assembly for covering a lyophilizer tray that contains a material for freeze-drying into a product in a lyophilizer chamber, said tray having an opening defined by a peripheral lip, said lid assembly comprising:

a first lid that includes an opening, said first lid being disposable to seal around the lip of the tray;

a second lid disposable onto said first lid to cover said opening, said second lid including a hole over said opening; and a filter paper disposed over said opening between said first and second lids for inhibiting the product from escaping the tray through said hole while permitting water vapor to pass therethrough.

2. The lid assembly of claim 1, further comprising a gasket disposed between said first and second lids to seal an interface therebetween and to hold said filter paper.

3. The lid assembly of claim 1, further comprising a fastener disposed to secure said second lid to said first lid.

4. The lid assembly of claim 1, further comprising a lyophilization stopper that fits said hole, said stopper disposed to seal said hole within the chamber upon completion of producing the product.

5. The lid assembly of claim 1, wherein said filter paper is high efficiency particulate air (HEPA) filter paper.

6. The lid assembly of claim 1, wherein said first lid includes a continuous groove for engaging the lip of the tray, said groove being disposed along a distal surface that faces and seals the tray.

7. A lid assembly for covering a lyophilizer tray that contains a material for freeze-drying into a product in a lyophilizer chamber, said tray having an opening defined by a peripheral lip, said lid assembly comprising:

a first lid that includes an opening, said first lid being disposable to seal around the lip of the tray;

a second lid disposable onto said first lid to cover said opening, said second lid including a hole over said opening;

a gasket disposed between said first and second lids;

a filter paper attached to said gasket and disposed over said opening between said first and second lids for inhibiting the product from escaping the tray through said hole while permitting water vapor to pass therethrough; and a fastener disposed to secure said first and second lids together.

8. The lid assembly of claim 7, further comprising a lyophilization stopper that fits atop said hole, said stopper disposed to seal said hole within the chamber upon completion of producing the product.

9. The lid assembly of claim 7, wherein said filter paper is high efficiency particulate air (HEPA) filter paper.

10. The lid assembly of claim 7, wherein said first lid includes a continuous groove for engaging the lip of the tray, said groove being disposed along a distal surface that faces and seals the tray.

11. A method for containing, within a lyophilization tray, a freeze dried product produced from a material subjected to lyophilization in a lyophilization chamber, said method comprising:

disposing the material into the lyophilizer tray, which has a peripheral lip;

placing a lid assembly over the lyophilizer tray, wherein said lid assembly includes a first lid that includes an opening, said first lid being disposable to seal around said lip of the tray;

a second lid disposable onto said first lid to cover said opening, said second lid including a hole over said opening; and a filter paper disposed over said opening between said first and second lids for inhibiting the product from escaping the tray through said hole while permitting water vapor to pass therethrough;

disposing a lyophilization stopper atop said hole while enabling vapor to escape from the tray;

inserting the tray and said lid assembly into the chamber;

lyophilizing the material in the chamber to produce the product;

releasing said vacuum inside the chamber upon completion of lyophilization; and pressing said stopper atop said hole to seal said product inside the tray.

12. The method of claim 11, wherein said lid assembly includes a gasket disposed between said first and second lids to seal an interface therebetween and to hold said filter paper.

13. The method of claim 11, further including removeably attaching said first and second lids together with a fastener.

14. The method of claim 11, further including aligning a groove along a outer periphery of a distal surface of said first lid with a lip atop the lyophilizer tray.

* * * * *